US006336400B1

(12) United States Patent
Orimoto et al.

(10) Patent No.: US 6,336,400 B1
(45) Date of Patent: Jan. 8, 2002

(54) STENCIL PRINTING MACHINE

(75) Inventors: Masaki Orimoto; Hideaki Nogi, both of Ibaraki-ken (JP)

(73) Assignee: Riso Kaguku Corporation, Tokyo (JP)

( * ) Notice: Subject to any disclaimer, the term of this patent is extended or adjusted under 35 U.S.C. 154(b) by 0 days.

(21) Appl. No.: 09/605,088

(22) Filed: Jun. 26, 2000

(30) Foreign Application Priority Data

Jun. 29, 1999 (JP) ..... 11-183690

(51) Int. Cl.[7] ..... B41L 13/04
(52) U.S. Cl. ..... 101/116; 101/120; 101/216
(58) Field of Search ..... 101/116, 119, 101/120, 114, 216, 248, 485, 486

(56) References Cited

U.S. PATENT DOCUMENTS 3,312,165 A * 4/1967 Strom ..... 101/119
5,537,920 A * 7/1996 Hasegawa et al. ..... 101/116
5,642,663 A * 7/1997 Hara ..... 101/116
5,694,841 A * 12/1997 Sato ..... 101/116
5,893,323 A * 4/1999 Ishii et al. ..... 101/116

FOREIGN PATENT DOCUMENTS

EP 0 888 898 A1 1/1999

* cited by examiner

*Primary Examiner*—Ren Yan
(74) *Attorney, Agent, or Firm*—Nath & Associates PLLC; Gary M. Nath; Marvin C. Berkowitz

(57) ABSTRACT

According to the stencil printing machine of the present invention, the printing drum unit is moved from a side direction to the pulled-out first support rail so that the one support rod is supported. That is, unnecessary becomes the operation of holding up the printing drum unit once upwards and then bringing down the unit. Moreover, the one support rod is supported so that the printing drum unit is provisionally supported. Thus, this unit can be supported by one hand. In this state, the second support rail is pulled out and the other support rod is supported by the second support rod, so that the pair of the support rods is supported by the first and second support rails. In this way, setting-up of the printing drum unit is completed.

12 Claims, 7 Drawing Sheets

STENCIL PRINTING MACHINE

BACKGROUND OF THE INVENTION

1. Field of the Invention

The present invention relates to a stencil printing machine for bringing an ink supply roller wherein ink is supplied onto its outer peripheral surface into contact with the inner peripheral surface of a printing drum and transferring the ink which has permeated through a stencil sheet to a sheet, thereby printing on the sheet, and relates in particular to an improvement in a structure for setting up a printing drum unit to the body of a printing machine, and a structure for supplying ink to an ink supply roller.

2. Description of the Related art

In a stencil printing machine, a printing drum on which a stencil sheet is wound around is set up to the body of a printing machine in the manner that the drum can be freely put on and taken off. In this way, the stencil printing machine is made to cope with the sort of printing color or maintenance. As shown in FIG. 1, an ink supply roller 3 is arranged inside a printing drum 1. The outer peripheral surface of the ink supply roller 3 is brought into contact with the inner peripheral surface of the printing drum 1. An ink amount control member (doctor rod) 5 is also arranged inside the printing drum 1 in the manner that the member 5 is located at a given interval from the outer peripheral surface of the ink supply roller 3 and in parallel to the roller 3. In this manner, a wedge-form ink pool 7 is made between the outer peripheral surface of the ink supply roller 3 and the outer peripheral surface of the ink amount control member 5 to be sandwiched therebetween.

An ink driving rod 9, which is in parallel to the ink supply roller 3, is rotatably arranged inside the ink pool 7. A non-illustrated gear fitted to one end of the ink driving rod 9 is engaged with a non-illustrated gear fitted to one end of the ink supply roller 3, so that the rod 9 can be rotated oppositely to the direction of the rotation of the ink supply roller 3 and in synchronization with the rotation thereof.

In operation of the stencil printing machine, the printing drum 1 is rotated in the direction of an arrow A, and the ink supply roller 3 is rotated in the direction of an arrow B. Thus, ink in the ink pool 7 revolves in a whirl around the ink driving rod 9 to produce an ink lump 11. The ink for producing the ink lump is supplied through an ink supply member (distributer) 13.

As shown in FIG. 2, conventionally, in the printing drum 1 having such a structure, its both ends in the axial direction of the drum 1 are rotatably supported by brackets 15. The brackets 15 at the two ends are connected with each other through support rods 17. These brackets 15, the support rods 17 and the printing drum constitute a printing drum unit 2.

A printing drum receiving section 19 is made in the body of the printing machine. A pressure drum 21 that can be freely rotated is arranged in the printing drum receiving section 19. A pair of parallel support rails 23 are fixed in the printing drum receiving section 19. The support rails 23 are positioned to have the same level above the pressure drum 21. In connection with the printing drum receiving section 19, openings are made, for example, in a side of the printing machine body and the two support rails 23 are slid and pulled out from the openings. The printing drum unit 2 is once held up and is then brought below the position between the support rails 23. In this way, the support rods 17 are hung on the support rails 23 so that the printing drum unit 2 can be fitted into the printing drum receiving section 19.

However, in the above-mentioned conventional stencil printing machine, a pair of the support rails in the printing drum receiving section is secured at the same level. Therefore, in order to fit the printing drum unit into the printing drum receiving section, it is unavoidable to hold up the printing drum unit once above the support rails and then bring down the unit, thereby hanging the support rods on the support rails. Thus, large power is necessary so that the printing drum unit cannot easily be fitted.

In the case of multicolor printing or color printing, as shown in FIG. 3, plural printing drums 2*a*and 2*b*must be arranged above the central axis of a pressure drum 21 in a stencil printing machine. However, in the case that ink supply rollers 3 having the same structure are set up, the setting-up angles of the rollers 3 are caused to be different at the right and left printing drum units 2*a*and 2*b*. Therefore, in the one printing drum unit 2*a*, ink from a distributer 13 drops on the ink supply roller 3 to be supplied thereto. In the other printing drum unit 2*b*, however, there arises a problem that ink from a distributer 13 comes not to drop on the ink supply roller 3 so as to cause impossibility of supply of the ink. For this reason, in any stencil printing machine wherein plural printing drum units must be set up at different angles, it is difficult to make the printing drum units common.

SUMMARY OF THE INVENTION

In the light of the above-mentioned situations, the present invention has been made. An object thereof is to provide a stencil printing machine making it possible to set up a printing drum unit easily and further make the printing drum units, if any, common.

The stencil printing machine of a first aspect of the present invention comprises : a printing drum unit comprising a printing drum on which a stencil sheet is wound around, a pair of brackets which supports both ends of the printing drum so that the printing drum can be rotated, and at least one pair of support rods which is connected with the pair of the brackets and arranged in the same direction as the axial line of the printing drum; a printing drum receiving section having an opening, at a side position of a printing machine body, through which the printing drum unit can be put on and taken off, whereby the section can receive the printing drum unit; a first support rail which is disposed in the printing drum receiving section and is freely pulled out in a horizontal direction from the opening, whereby the first support rail supports the one support rod; and a second support rail which is disposed below the first support rail in the printing drum receiving section and is freely pulled out in a horizontal direction from the opening, whereby the second support rail supports the other support rod.

According to the stencil printing machine of the first aspect, the printing drum unit is moved from a side direction to the pulled-out first support rail so that the one support rod is supported. That is, unnecessary becomes the operation of holding up the printing drum unit once upwards and then bringing down the unit. Moreover, the one support rod is supported so that the printing drum unit is provisionally supported. Thus, this unit can be supported by one hand. In this state, the second support rail is pulled out and the other support rod is supported by the second support rail, so that the pair of the support rods is supported by the first and second support rails. In this way, setting-up of the printing drum unit is completed.

On the other hand, the stencil printing machine of a second aspect of the present invention comprises: a printing drum unit comprising a printing drum on which a stencil sheet is wound around, a pair of brackets which supports both ends of the printing drum so that the printing drum can be rotated, and at least one pair of support rods which is connected with the pair of the brackets and arranged in the same direction as the axial line of the printing drum; a printing drum receiving section having an opening, at a side position of a printing machine body, through which the printing drum unit can be put on and taken off, whereby the section can receive the printing drum unit; a first support rail which is disposed in the printing drum receiving section and is freely pulled out in a horizontal direction from the opening, whereby the first support rail supports the one support rod; a second support rail which is disposed below the first support rail in the printing drum receiving section and is freely pulled out in a horizontal direction from the opening, whereby the second support rail supports the other support rod; an ink supply roller which is disposed inside the printing drum and whose outer peripheral surface is brought in contact with the inner peripheral surface of the printing drum, whereby the ink supply roller is rotated; an ink supply member which is disposed inside the printing drum to jet out ink; and an ink guide roller which is positioned between the ink supply member and the ink supply roller to deliver the ink supplied from the ink supply member to the ink supply roller.

The stencil printing machine of the second aspect exhibits the same effect as the stencil printing machine of the first aspect. Moreover, the ink supplied from the ink supply member is delivered to the ink supply roller through the ink guide roller, so as to remove any restriction on the printing drum setting-up angle, which is essential for conventional ink supply structures in which ink is caused to drop freely. In this way, the direction along which the printing drum unit is set up becomes unrestricted so that, in any stencil printing machine having a plurality of the printing drum units, the printing drum units can be made common.

Other and further objects and features of the present invention will become obvious upon understanding of the illustrative embodiments about to be described in connection with the accompanying drawings or will be indicated in the appended claims, and various advantages not refereed to herein will occur to one skilled in the art upon employing of the invention in practice.

BRIEF DESCRIPTION THE DRAWINGS

DETAILED DESCRIPTION OF THE PREFERRED EMBODIMENTS

Figure 1:
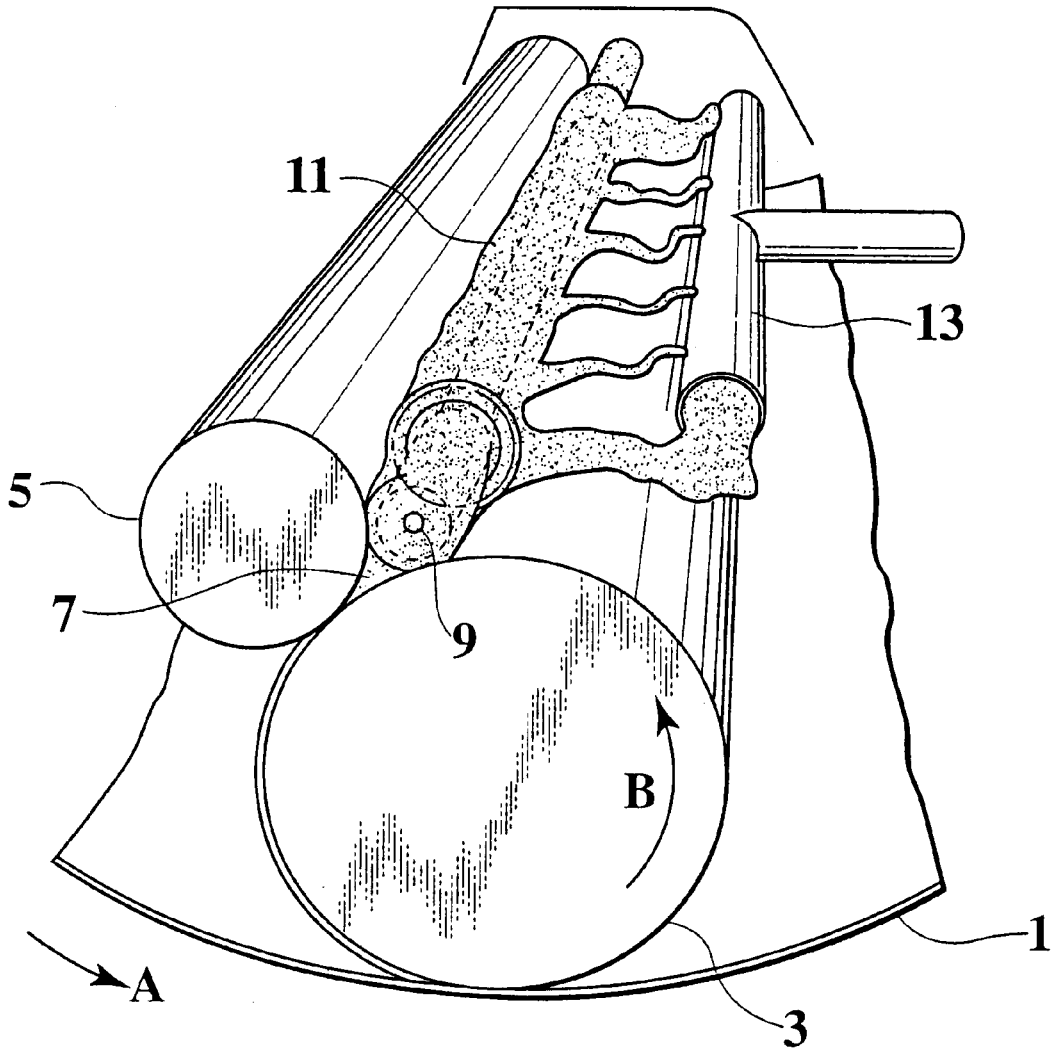
FIG.1 Prior Art
FIG. 1 is a perspective view illustrating an ink supply state in a conventional stencil printing machine.
Figure 2:
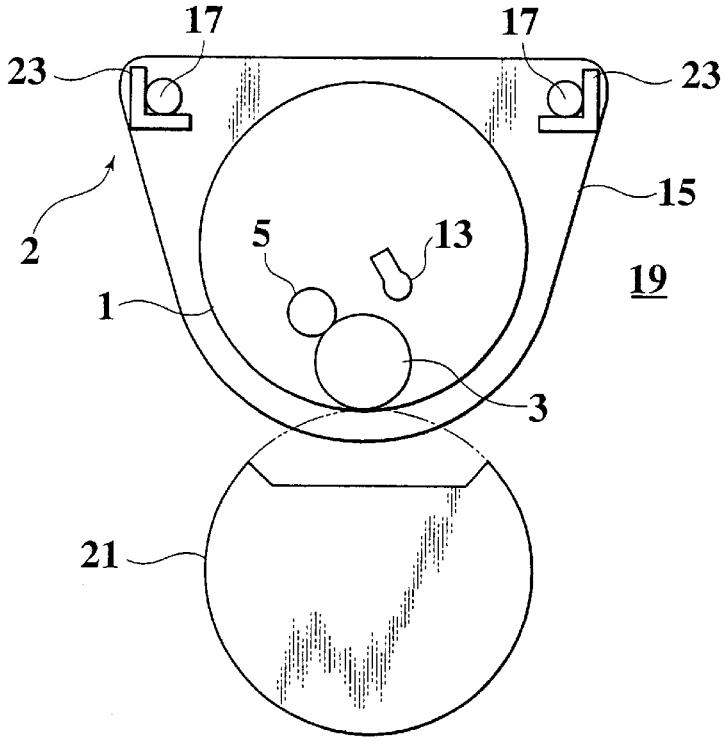
FIG.2 Prior Art
FIG. 2 is a side view illustrating the position where a printing drum unit is set up in the conventional stencil printing machine.
Figure 3:
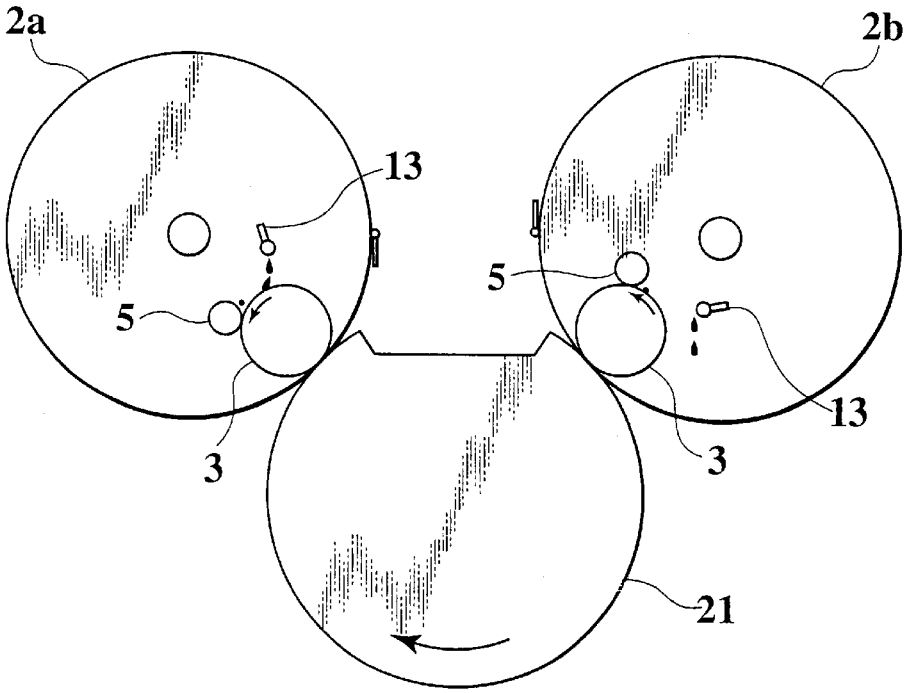
FIG.3 Prior Art
FIG. 3 is a side view illustrating plural printing units set up in a conventional stencil printing machine.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Referring to the drawings, the following will in detail describe preferred embodiments of the stencil printing machine according to the present invention.

Figure 4:
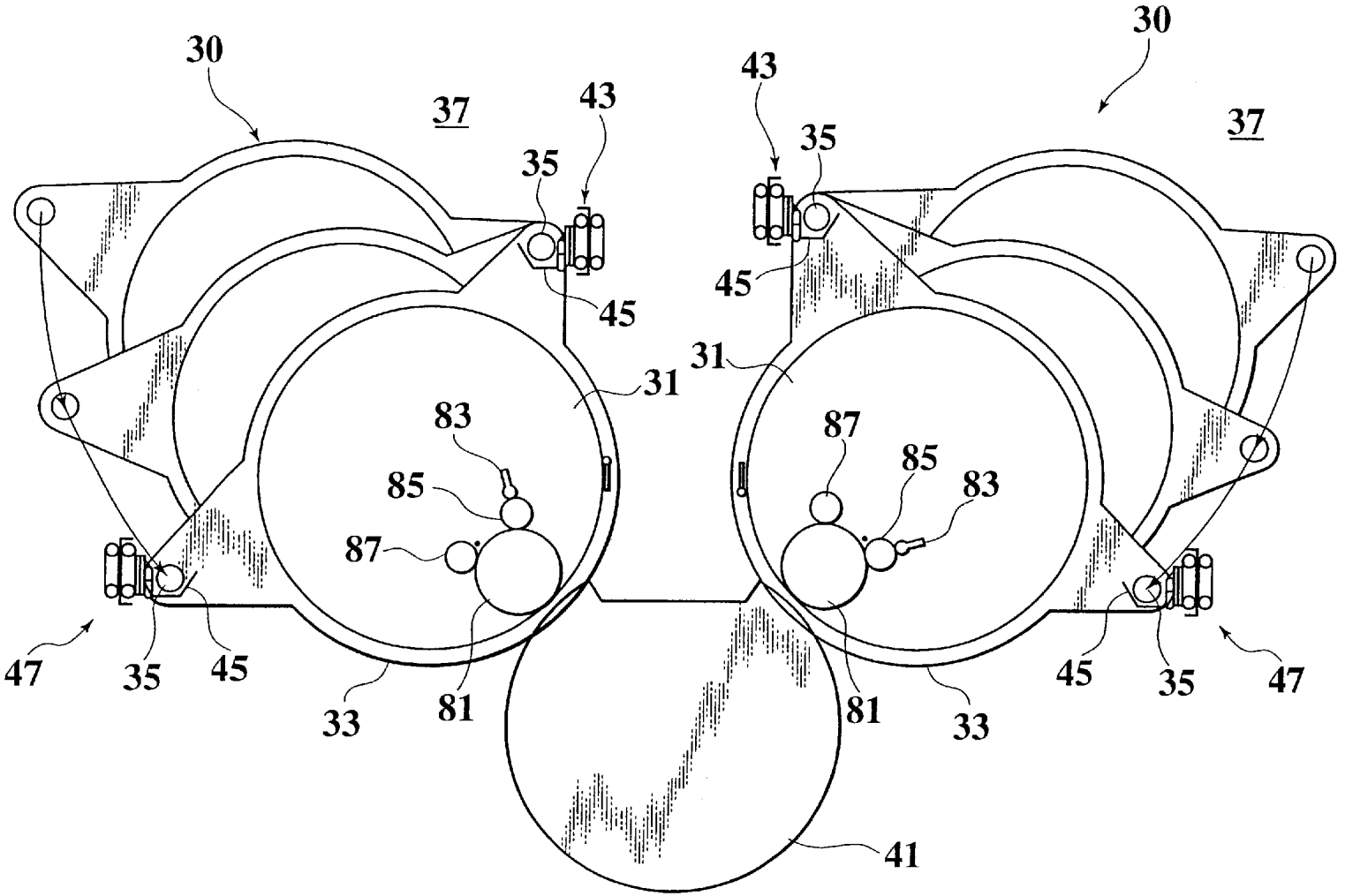
FIG. 4 is a side view of a printing drum receiving section in a stencil printing machine according to the present invention.
Figure 5:
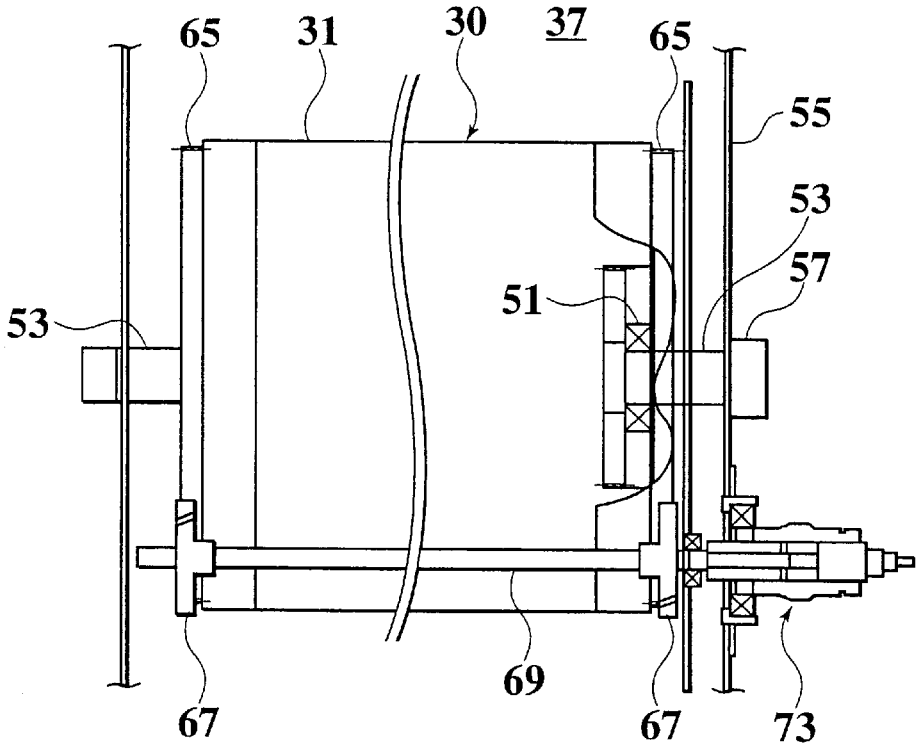
FIG. 5 is a front view illustrating a structure for connecting a printing drum unit and the body of the printing machine.
Figure 6:
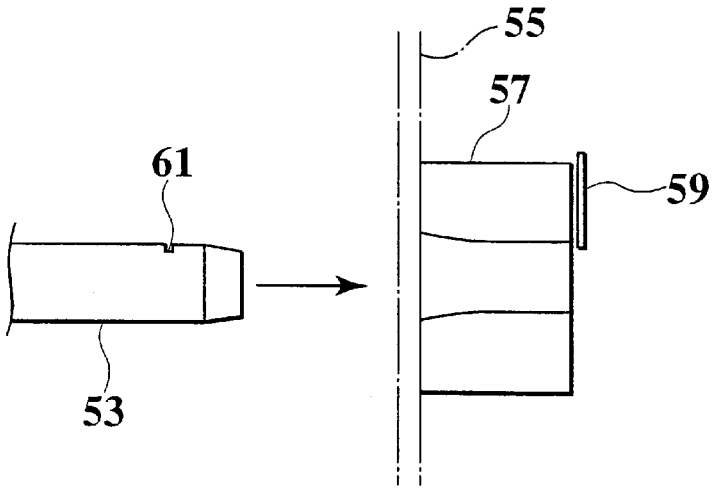
FIG. 6 is a front view illustrating a structure for connecting the central axis of the printing drum and a shaft bearing of the body.
Figure 7:
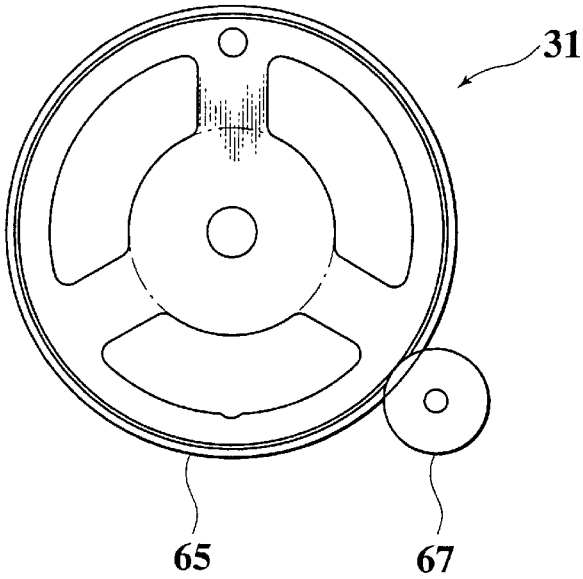
FIG. 7 is a side view of an end portion of the printing drum unit.
Figure 8:
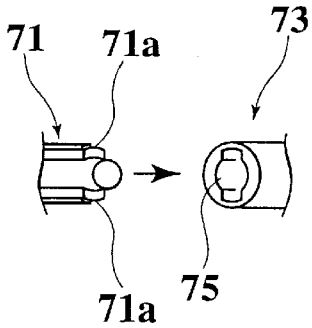
FIG. 8 is a perspective view illustrating a structure for connecting a driving axis and a trailing axis.

FIG. 4 is a side view of a printing drum receiving section in a stencil printing machine according to the present invention. FIG. 5 is a front view illustrating a structure for connecting a printing drum unit and the body of the printing machine. FIG. 6 is a front view illustrating a structure for connecting the central axis of the printing drum and a shaft bearing of the body. FIG. 7 is a side view of an end portion of the printing drum unit. FIG. 8 is a perspective view illustrating a structure for connecting a driving axis and a trailing axis.

As illustrated in FIG. 4, each of printing drums 31, on which a stencil sheet is wound around, is rotatably supported, at its both ends in the axial direction of the drum, by a pair of flange-form brackets 33. The pair of the brackets 33 is connected with each other through a pair of support rods 35 arranged in the same direction as the axial line of the printing drum 31. The number of the needed support rods 35 is at least two. Of course, the number of the used support rods 35 may be three or more, in order to make connection strength higher. A printing drum unit 30 is composed mainly of the brackets 33, the support rods 35 and the printing drum 31.

Printing drum receiving sections 37 are formed in a non-illustrated printing machine body. Each of the printing drum receiving sections 37 can receive the printing drum 31. A pressure drum 41 that can be freely rotated is arranged in the printing machine body. In the printing drum unit 30 received in the printing drum receiving section 37, the outer periphery of the printing drum 31 contacts the outer periphery of the pressure drum 41. Openings 39 (see FIG. 12) for putting on and taking off the printing drum units 30 are made in the printing drum receiving sections 37, that is, in a side position of the printing machine body. In this embodiment, the two printing drum units 30 are set up above the pressure drum 41. Therefore, the side of the printing machine body has the two openings 39.

The printing drum receiving section 37 is provided with a first support rail 43. The first support rail 43 can be freely pulled out in a horizontal direction (the direction perpendicular to the paper surface of FIG. 4) from the opening 39. An engaging plate 45 having, for example, an L-shaped section is fixed to the side face, opposite to the printing drum 31, of the first support rail 43. The engaging plate 45 can engage with one support rod 35 in the printing drum unit 30. That is, the first support rail 43 is pulled out from the opening 39 and the single support rod 35 is engaged with the engaging plate 45, so that one side of the printing drum unit 30 can be supported by the printing machine body. In this state, the printing drum unit 30 can be supported by one hand.

The printing drum receiving section 37 has a second support rail 47 at a position opposite to the printing drum 31 from the first support rail 43. The second support rail 47 can be freely pulled out in a horizontal direction from the opening 39, too. This second support rail 47 is arranged at a position below the first support rail 43 in the printing drum receiving section 37. An engaging plate 45 having an L-shaped section is fixed to the side face, opposite to the printing drum 31, of the second support rail 47. This engaging plate 45 can engage with the other support rod 35 in the printing drum unit 30. That is, the second support rail 47 is pulled out from the opening 39 and the other support rod 35 is engaged with the engaging plate 45, so that the whole of the printing drum unit 30 can be supported by the printing machine body. In this sate, the printing drum unit 30 can be supported, without support by any hand, by the printing machine body.

As illustrated in FIG. 5, the printing drum 31 is rotatably supported by a printing drum central axis 53 in the manner that its both ends are held through axis bearings 51 by the printing drum central axis 53. This printing drum central axis 53 is supported by the above-mentioned brackets 33 and is projected outwards from the brackets 33. An axis bearing 57 is fixed to a side plate 55, which is present at the side of the print machine body, of the printing drum receiving section 37. The printing drum central axis 53 is fitted into the axis bearing 57.

As illustrated in FIG. 6, a flexible fixing plate 59 is set up onto the side of the axis bearing 57. A part of the fixing plate 59 is projected into a fitting hole of the axis bearing 57. A fixing groove 61 is made in the outer periphery at the tip side of the printing drum central axis 53, so that the fixing grove 61 can engage with the fixing plate 59. Therefore, by inserting the printing drum unit 30 into the printing drum receiving section 37, the printing drum central axis 53 is inserted into the axis bearing 57. By engaging the fixing grove 61 with the fixing plate 59, the printing drum unit 30 is fixed to the printing machine body. The fixing plate 59 can be moved by 35 a non-illustrated fixation releasing means. At the time of putting on and taking off the printing drum unit 30, the engagement of the fixing plate 59 with the fixing groove 61 can be released.

As illustrated in FIG. 7, external gears 65 are made in both ends in the axial direction of the printing drum 31, and the external gears 65 are engaged with printing drum driving gears 67 located near the outer periphery of the printing drum 31. As illustrated in FIG. 5, the printing drum driving gear 67 is secured to a trailing axis 69 in the same direction as the axial line of the printing drum 31. The trailing axis 69 is rotatably supported, at its both ends, by the above-mentioned pair of brackets 33. As illustrated in FIG. 8, an engaging portion 71 having projections 71*a*from its outer periphery is formed on the tip portion, which is present at the side of the side plate 55, of the trailing axis 69. A driving axis 73 is fitted, at a position corresponding to the trail axis 69, to the side plate 55. An engaging hole 75 which engages with the engaging portion 71 is made in the tip portion of the driving axis 73. When the printing drum unit 30 is set up in the printing drum receiving section 37, the engaging portion 71 of the trailing axis 69 is fitted into the engaging hole 75. In this way, the trailing axis 69 is connected with the driving axis 73 in such a manner that they do not rotate relatively. As a result, driving power is transmitted from the printing machine body.

Figure 9:
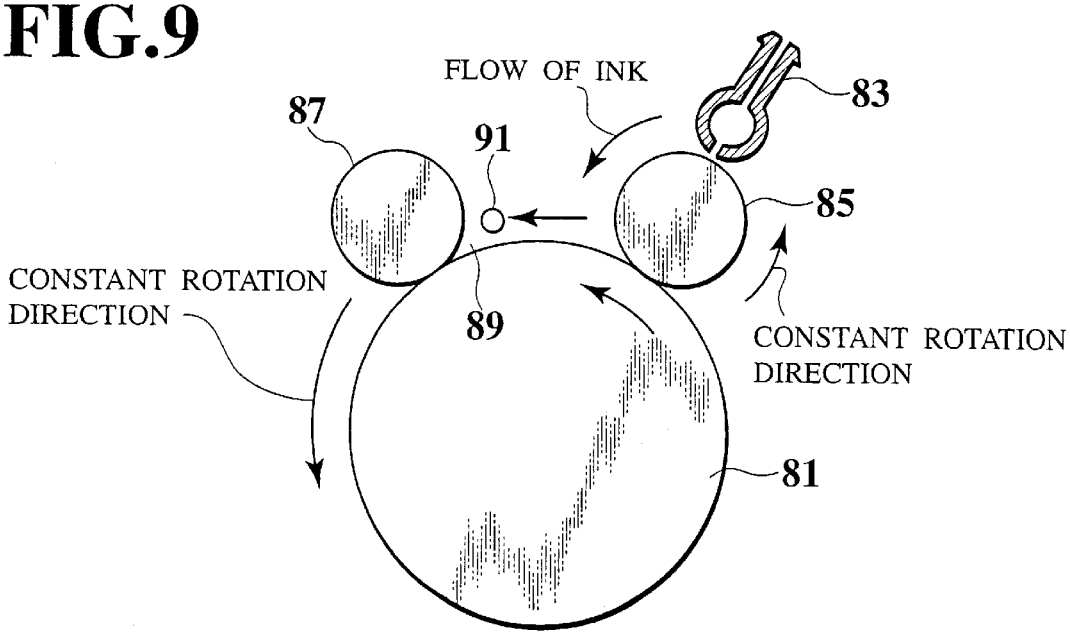
FIG. 9 is a side view illustrating an ink supply structure of the stencil printing machine according to the present invention
Figure 10:
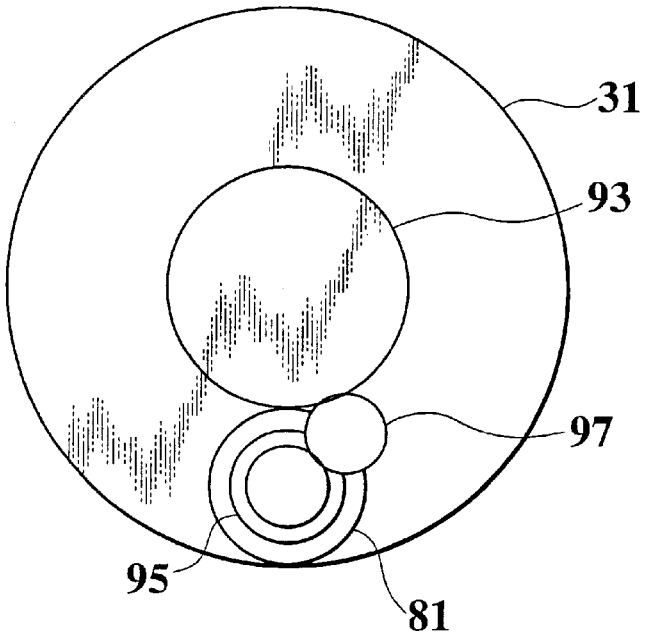
FIG. 10 is a side view illustrating a drive transmission mechanism of the ink supply structure illustrated in FIG. 9.
Figure 11:
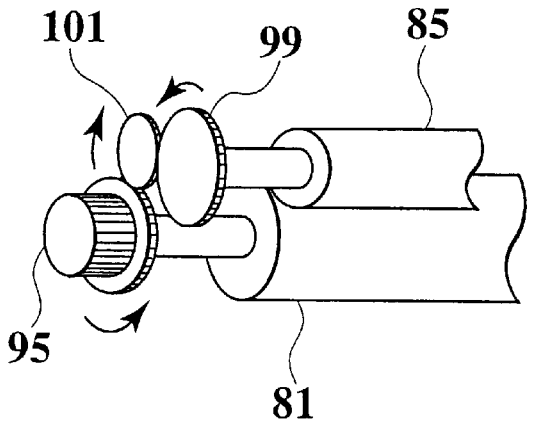
FIG. 11 is a perspective view illustrating a drive transmission mechanism of an ink guide roller.

The following will describe an ink supply structure. set up inside the printing drum, on the basis of FIGS. 9–11. FIG. 9 is a side view illustrating an ink supply structure of the stencil printing machine according to the present invention. FIG. 10 is a side view illustrating a drive transmission mechanism of the ink supply structure illustrated in FIG. 9. FIG. 11 is a perspective view illustrating a drive transmission mechanism of an ink guide roller.

An ink supply roller 81 is located inside the printing drum 31. The outer peripheral surface of the ink supply roller 81 is brought into contact with the inner peripheral surface of the printing drum 31. Inside the printing drum 31, an ink supply member (distributer) 83 for jetting out ink is arranged at an interval from the printing drum 31. An ink guide roller 85 is positioned between the ink supply roller 81 and the distributer 83. The ink guide roller 85 is located between the distributer 83 and the ink supply roller 81 and at a very small interval therefrom making delivery of ink possible. That is, the ink supplied from the distributer 83 is supplied through the ink guide roller 85 to the ink supply roller 81.

In this ink supply structure, which is different from conventional ink supply structures of an ink-drop type, the distributer 83 is positioned at a very small interval from the ink guide roller 85. Therefore, the ink supply from the distributer 83 does not depend on an ink-drop direction. It is therefore unnecessary to regulate the angle at which the printing drum 31 is set up in the manner that the ink drop direction becomes substantially vertical direction.

Inside the printing drum 31, an ink amount control member (doctor rod) 87 is arranged at a given interval from the outer peripheral surface of the ink supply roller 81 and in parallel to the ink supply roller 81. In this way, an ink pool 89 is formed between the outer peripheral surface of the ink supply roller 81 and the outer peripheral surface of the ink amount control member 87 so as to be sandwiched therebetween. Inside this ink pool 89, an ink driving rod 91 is rotatably arranged in the parallel to the ink supply roller 81.

As illustrated in FIG. 10, a printing drum gear 93 having an axis equal to that of the printing drum 31 is secured inside the printing drum 31. The printing drum gear 93 is rotated in the synchronization with the rotation of the printing drum 31. A supply roller gear 95 is secured to the end of the axis of the ink supply roller 81. A middle gear 97 is being engaged with the supply roller gear 95 and the printing drum gear 93. That is, motive power is transmitted from the printing drum gear 93 to the ink supply roller 81 through the middle gear 97, so that the roller 81 is driven and rotated in synchronization with the printing drum 31.

A non-illustrated gear fixed to one end of the ink driving rod 91 is being engaged with the supply roller gear 95 of the ink supply roller 81, so that the rod 91 is reversibly rotated in synchronization with the rotation of the ink supply roller 81.

As illustrated in FIG. 11, a guide roller gear 99 is secured to an end portion of the ink guide roller 85. A drive transmitting gear 101 is being engaged with the supply roller gear 95 and the guide roller gear 99. Therefore, motive power is transmitted from the supply roller gear 95 to the ink guide roller 85 through the drive transmitting gear 101, so that the roller 85 is driven and rotated in synchronization with the ink supply roller 81. A non-illustrated rotation direction regulating member (one-way clutch) is set up to the guide roller gear 99, so that the rotation of the ink guide roller 85 is regulated to one direction.

Figure 12A:
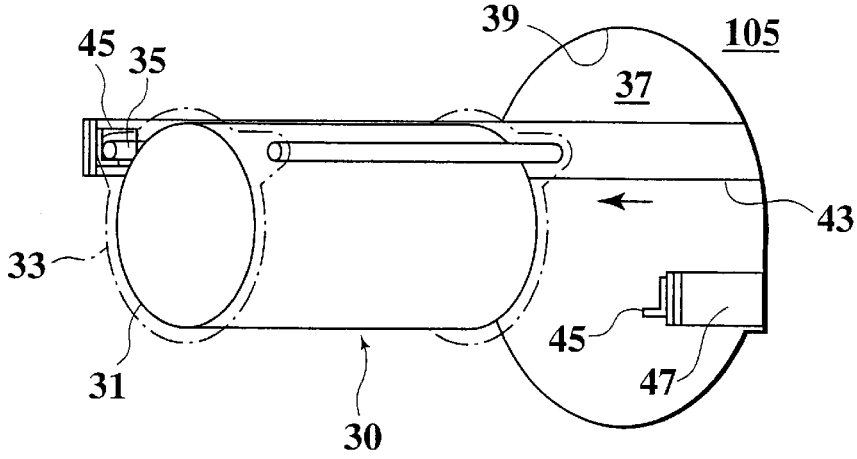
FIGS. 12A, 12B and 12C are views illustrating a process for setting up the printing drum unit of the stencil printing machine according to the present invention.
Figure 12B:
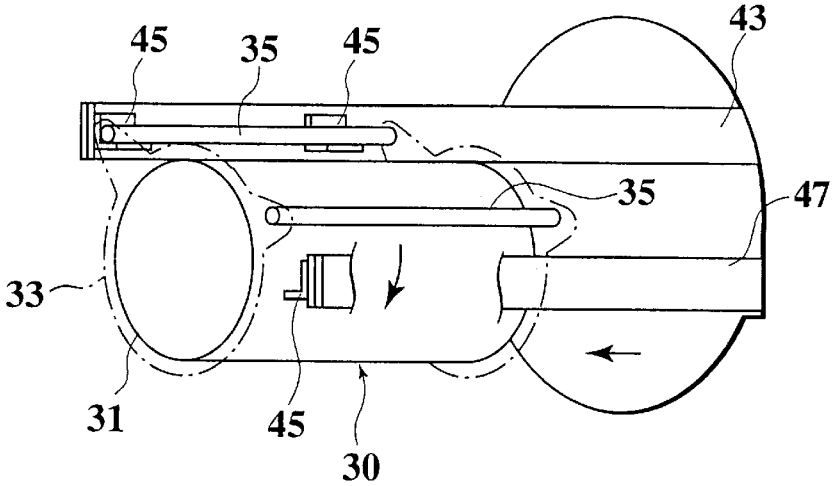
Figure 12C:
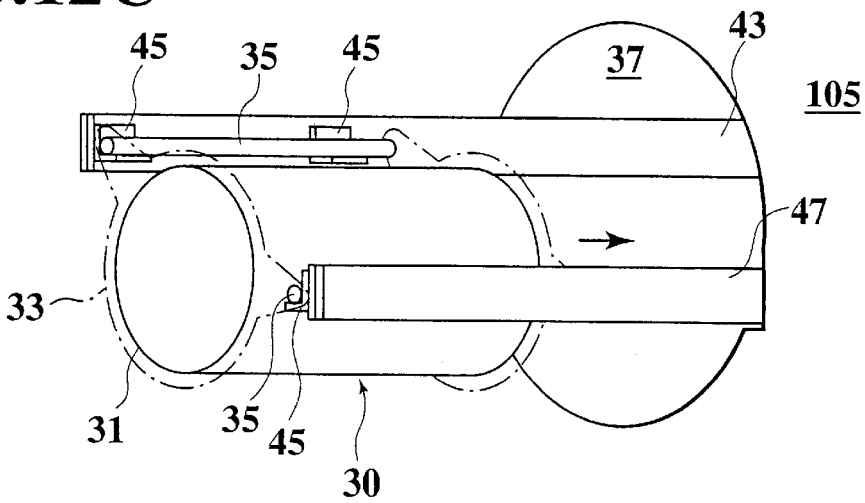

The following will describe a process for setting up the printing drum of the stencil printing machine having such a structure on the basis of FIGS. 12A–C. FIGS. 12A–C are views showing a process for setting up the printing drum of the stencil printing machine according to the present invention.

As illustrated in FIG. 12A, in order to set up the printing drum unit 30, the first support rail 43 is first pulled out from the opening 39 of the printing machine body 105. Next, the one support rod 35 of the printing drum unit 30 is engaged with the engaging plate 45 of the first support rail 43. At this time, the second support rail has not yet been pulled out, so that the printing drum unit 30 is moved from a side direction without being disturbed by the second support rail 43 to engage with the first support rail 47. In this way, the printing drum unit 30 is provisionally supported by the printing machine body 105 so that the unit 30 can be supported by one hand.

As illustrated in FIG. 12B, next, the second support rail 47 is pulled out by the other hand. When the second support rail 47 is pulled out, the printing drum unit 30 is rotated in the direction shown by an arrow around the support rod 35 that has already been supported by the engaging plate 45 as illustrated in FIG. 4. Moreover, in this way, the support rod 35 that has not yet been supported is engaged with the engaging plate 45 of the second support rail 47. Since at this time the second support rail 47 is arranged below the first support rod 43, the printing drum unit 30 can easily be supported by the second support rail 47 only by rotating and moving the printing drum unit 30 downwards. In this way, the printing drum unit 30 is supported by the printing machine body 105 through the first and second support rails 43 and 47, as illustrated in FIG. 12C. At last, the first and second support rails 43 and 47, through which the printing drum unit 30 is supported, together with the printing drum unit 30, are slid and moved to the printing drum receiving section 37 and are received in the section 37. In this way, the setting-up of the printing drum unit 30 is completed.

The printing drum unit 30 can be taken off from the printing machine body 105 by the process reverse to the above-mentioned process.

As described above, according to the above-mentioned stencil printing machine, the printing drum unit 30 is moved from a side direction to the pulled-out first support rail 43 so that the one support rod 35 is supported. That is, unnecessary becomes the operation of holding up the printing drum unit 30 once in the direction over the support rail and then bringing down the unit 30. Moreover, the one support rod 35 is supported so that the printing drum unit 30 is provisionally supported. Thus, the unit 30 can be supported by one hand. In this state, the second support rail 47 is pulled out and the printing drum unit 30 is rotated and moved downwards, so that the unit 30 can easily be supported by the second support rail. In this way, it becomes possible to set up the printing drum unit 30 easily.

The first and second support rails 43 and 47 may have a structure so as to be pulled out at the same time.

The ink supplied from the distributer 83 is delivered to the ink supply roller 81 through the ink guide roller 85, so as to remove any restriction on the printing drum setting-up angle, which is essential for conventional ink supply structures in which ink is caused to drop freely. In this way, the direction along which the printing drum unit 30 is set up becomes unrestricted so that, in any stencil printing machine having a plurality of the printing units 30, the printing drum unit 30 can be made common.

OTHER EMBODIMENTS

Various modifications will become possible for those skilled in the art after receiving the teachings of the present disclosure without depending from the scope thereof.

As described above, of course, the present invention includes various embodiments that are not described herein. Therefore, the technical scope of the present invention is defined only by the following claims that are proper in the light of the above description.

What is claimed is:

1. A stencil printing machine, comprising:

a printing drum unit comprising a printing drum on which a stencil sheet is wound around, a pair of brackets which supports both ends of the printing drum so that the printing drum can be rotated, and at least one pair of support rods, each having a longitudinal axis, which is connected with the pair of the brackets and arranged in the same direction as the axial line of the printing drum;

a printing drum receiving section having an opening, at a side position of a printing machine body, through which the printing drum unit can be put on and taken off, whereby the section can receive the printing drum unit;

a first support rail which is disposed in the printing drum receiving section and is freely pulled out in a horizontal direction from the opening, the first support rail removably carries a first one of the at least one pair of support rods, the printing drum unit being pivotable about the longitudinal axis of the first support rod through a pivot arc; and a second support rail which is disposed vertically offset from the first support rail in the printing drum receiving section and is freely pulled out in a horizontal direction from the opening, the second support rail removably carries an other of the at least one pair of support rods;

whereby the pivot arc has an endpoint that terminates at the second support rail.

2. The stencil printing machine according to claim 1, wherein the first and second support rails have a structure so as to be pulled out at the same time.

3. The stencil printing machine according to claim 1, further comprising:

L-shaped engaging plates, each of which is fitted on side face of each of the first and second support rails, the side face being opposite to the printing drum;

wherein the engaging plates engage with the support rods of the printing drum unit.

4. The stencil printing machine according to claim 1 wherein each of said first and second support rails is pulled out independently of the other of said support rails.

5. The stencil printing machine according to claim 1 further comprising a further printing drum unit having third and fourth support rods, said third support rod being carried by a third support rail and said fourth support rod being carried by a fourth support rail.

6. The stencil printing machine as claimed in claim 5 wherein said further printing drum unit is pivotable about an axis of said third support rod through a further pivot arc, whereby the further pivot arc has an endpoint that terminates at said fourth support rail.

7. A stencil printing machine, comprising:

a printing drum unit comprising a printing drum on which a stencil sheet is wound around, a pair of brackets which supports both ends of the printing drum so that the printing drum can be rotated, and at least one pair of support rods, each having a longitudinal axis, which is connected with the pair of the brackets and arranged in the same direction as the axial line of the printing drum;

a printing drum receiving section having an opening, at a side position of a printing machine body, through which the printing drum unit can be put on and taken off, whereby the section can receive the printing drum unit;

a first support rail which is disposed in the printing drum receiving section and is freely pulled out in a horizontal direction from the opening, the first support rail removably carries a first one of the at least one pair of support rods, the printing drum unit being pivotable about the longitudinal axis of the first support rod through a pivot arc;

a second support rail which is disposed vertically offset from the first support rail in the printing drum receiving section and is freely pulled out in a horizontal direction from the opening, the second support rail removably carries an other of the at least one pair of support rods;

whereby the pivot arc has an endpoint that terminates at the second support rail;

an ink supply roller which is disposed inside the printing drum and whose outer peripheral surface is brought in contact with the inner peripheral surface of the printing drum, whereby the ink supply roller is rotated;

an ink supply member which is disposed inside the printing drum to supply ink; and an ink guide roller which is positioned between the ink supply member and the ink supply roller to deliver the ink supplied from the ink supply member to the ink supply roller.

8. The stencil printing machine according to claim 7, wherein the first and second support rods have a structure capable of being pulled out at the same time.

9. The stencil printing machine according to claim 7 wherein each of said first and second support rails is pulled out independently of the other of said support rails.

10. The stencil printing machine according to claim 7 further comprising a further printing drum unit having third and fourth support rods, said third support rod being carried by a third support rail and said fourth support rod being carried by a fourth support rail.

11. The stencil printing machine as claimed in claim 10 wherein said further printing drum unit is pivotable about an axis of said third support rod through a further pivot arc, whereby the further pivot arc has an endpoint that terminates at said fourth support rail.

12. The stencil printing machine according to claim 7 wherein the ink supply member is disposed proximate to the ink guide roller whereby ink supplied from the ink supply member is captured by the ink guide roller and transferred to the ink supply roller irrespective of a rotational alignment of the printing drum unit.

* * * * *